US007832379B2

(12) United States Patent
Schelhas et al.

(10) Patent No.: US 7,832,379 B2
(45) Date of Patent: Nov. 16, 2010

(54) DEVICE FOR PUMPING FUEL

(75) Inventors: Peter Schelhas, Stuttgart (DE); Michael Kuehn, Bietigheim-Bissingen (DE); Hans-Peter Braun, Renfrizhausen (DE); Thomas Wieland, Stuttgart (DE); Werner Schneider, Stuttgart (DE); Winfried Eckart, Ludwigsburg (DE); Christian Pankiewitz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 297 days.

(21) Appl. No.: 11/576,640

(22) PCT Filed: Oct. 4, 2005

(86) PCT No.: PCT/EP2005/054977

§ 371 (c)(1),
(2), (4) Date: Apr. 4, 2007

(87) PCT Pub. No.: WO2006/040274

PCT Pub. Date: Apr. 20, 2006

(65) Prior Publication Data

US 2008/0095642 A1 Apr. 24, 2008

(30) Foreign Application Priority Data

Oct. 9, 2004 (DE) ..... 10 2004 049 286

(51) Int. Cl.
*F02M 37/00* (2006.01)

(52) U.S. Cl. ..... 123/510; 123/514

(58) Field of Classification Search ..... 137/113, 137/15, 16, 238, 563, 625.18, 625.19, 625.46, 137/625.47, 625.28, 15.06, 240, 887, 100, 137/116.3; 359/452; 123/470, 184.47, 41.31, 123/514, 179.17, 541, 497, 456, 459, 506, 123/554, 446, 557, 458, 511, 510, 457; 118/50; 438/935; 156/345.29; 251/172, 309, 287, 251/180, 192, 214; 422/132; 470/79; 134/129, 134/18; 239/1, 106, 112; 15/60; 180/314; 73/864.83, 863.73; *F02M 37/00*
See application file for complete search history.

(56) References Cited

U.S. PATENT DOCUMENTS 3,131,708 A * 5/1964 Knight ..... 137/113

(Continued)

FOREIGN PATENT DOCUMENTS

DE 42 24 981 A1 2/1994

(Continued)

*Primary Examiner*—Michael Cuff
*Assistant Examiner*—Keith Coleman
(74) *Attorney, Agent, or Firm*—Ronald E. Greigg

(57) ABSTRACT

A devices for pumping fuel has at least one suction jet pump and a drive line, supplying the suction jet pump with fuel, that branches off from a pressure line leading to an internal combustion engine and that can be blocked off by means of a shutoff valve. By means of a shutoff valve, it is possible to switch off the suction jet pumps. The pressure of the pressure line acts on the shutoff valve in such a way that the shutoff valve closes at a pressure that is greater than or equal to a predetermined closing pressure.

15 Claims, 4 Drawing Sheets

U.S. PATENT DOCUMENTS

| | | | | |
|---|---|---|---|---|
| 5,289,810 | A | 3/1994 | Bauer et al. | |
| 5,551,404 | A * | 9/1996 | Bauerle et al. | 123/514 |
| 5,791,317 | A | 8/1998 | Eck | |
| 6,234,151 | B1 * | 5/2001 | Eck | 123/514 |
| 7,178,511 | B2 * | 2/2007 | Dickenscheid et al. | 123/514 |
| 7,275,524 | B2 * | 10/2007 | Schelhas et al. | 123/514 |
| 7,278,404 | B2 * | 10/2007 | Wolters et al. | 123/514 |
| 7,395,818 | B2 * | 7/2008 | Fujisawa et al. | 123/527 |
| 2001/0018908 | A1 * | 9/2001 | Joos et al. | 123/497 |

FOREIGN PATENT DOCUMENTS

| | | | |
|---|---|---|---|
| DE | 44 26 946 | A1 | 2/1996 |
| DE | 196 28 580 | A1 | 1/1998 |
| EP | 1 126 157 | A2 | 8/2001 |
| JP | 2-286865 | | 11/1990 |

* cited by examiner

DEVICE FOR PUMPING FUEL

CROSS-REFERENCE TO RELATED APPLICATION

This application is a 35 USC 371 application of PCT/EP 2005/054977 filed on Oct. 4, 2005.

BACKGROUND OF THE INVENTION

1. Field of the Invention

The invention is based on a device for pumping fuel and more particularly such a device for pumping fuel in an internal combustion engine.

2. Description of the Prior Art

German Patent DE 199 36 287 C2, discloses a device for pumping fuel, having a suction jet pump and a drive line that supplies the suction jet pump with fuel, which drive line branches off from a pressure line leading to an internal combustion engine and can be block off by means of a shutoff valve. By means of the electrically switchable shutoff valve, it is possible to switch off the suction jet pumps, regardless of the pressure downstream of a feed pump and regardless of the operating states of an internal combustion engine. A disadvantage is that the electrically switchable shutoff valve is comparatively expensive.

SUMMARY AND ADVANTAGES OF THE INVENTION

The device for pumping fuel according to the invention has the advantage over the prior art that in a simple way, an improvement is attained such that the production costs are reduced because the pressure of the pressure line acts on the shutoff valve in such a way that the shutoff valve automatically closes at a pressure that is greater than or equal to a predetermined closing pressure. In this way, an electrically switchable final control element is dispensed with.

Advantageous refinements of and improvements to the device defined by the main claim are disclosed. It is especially advantageous if the closing pressure of the shutoff valve is greater than the pressure in the pressure line in full-load operation of the engine, since in this way, even at full load, the filling of the splash pot with fuel is assured.

In an advantageous embodiment, the shutoff valve is embodied as a diaphragm valve or as a piston valve, since these are especially simple, economical embodiments.

It is also advantageous if the shutoff valve has both an input connection, fluidically communicating upstream with the pressure line, and a control connection as well as an output connection leading downstream to the at least one suction jet pump, since in this way it can be attained that the pressure of the pressure line causes the closure of the shutoff valve.

It is highly advantageous if the input connection discharges into a valve chamber, in which a first closing body, cooperating with a first valve seat, is located. In an advantageous version, it is provided that the first closing body be embodied in pistonlike fashion, with a first piston portion and/or a second piston portion.

It is also advantageous if the pressure of the pressure line acts on the first closing body in the direction toward the first valve seat, and a restoring spring is provided, which presses the first closing body in the direction remote from the first valve seat, since in this way at the first closing body, a balance of forces is obtained between the pressure force of the pressure line, acting on the first closing body, and the spring force of the restoring spring.

In an advantageous embodiment, the first piston portion is located in the valve chamber and reaches as far as the inside of the control chamber, and the second piston portion is provided in the control chamber.

It is also advantageous that the drive line branches off from the pressure line upstream of a check valve located in the pressure line, since it is thus attained that the shutoff valve is open when the feed pump is off.

It is furthermore advantageous if the drive line has a throttle element upstream or downstream of the shutoff valve, since in this way the volumetric flow from the pressure line to the at least one suction jet pump is limited.

In a further embodiment, it is advantageously provided that a control valve be located between the control connection and the control chamber, which control valve is for instance connected integrally with the shutoff valve.

It is advantageous if the control valve has a second closing body, cooperating with a second valve seat and with a third valve seat. An advantageous embodiment provides that the second closing body is embodied in pistonlike fashion and is axially movable between the second valve seat and the third valve seat.

It is also advantageous if the control chamber communicates fluidically with a leak fuel connection, when the second closing body is in contact with the second valve seat, since in this way the control chamber is pressure-relieved and can be evacuated via a leak fuel line.

Advantageously, the control chamber communicates fluidically with a control connection, when the second closing body is in contact with the third valve seat, since in this way the control chamber is subjected to the pressure of the pressure line.

DRAWINGS BRIEF DESCRIPTION OF THE DRAWINGS

Exemplary embodiments of the invention are described in detail herein below, in conjunction with the drawings, in which.

DESCRIPTION OF THE PREFERRED EMBODIMENTS

Figure 1:
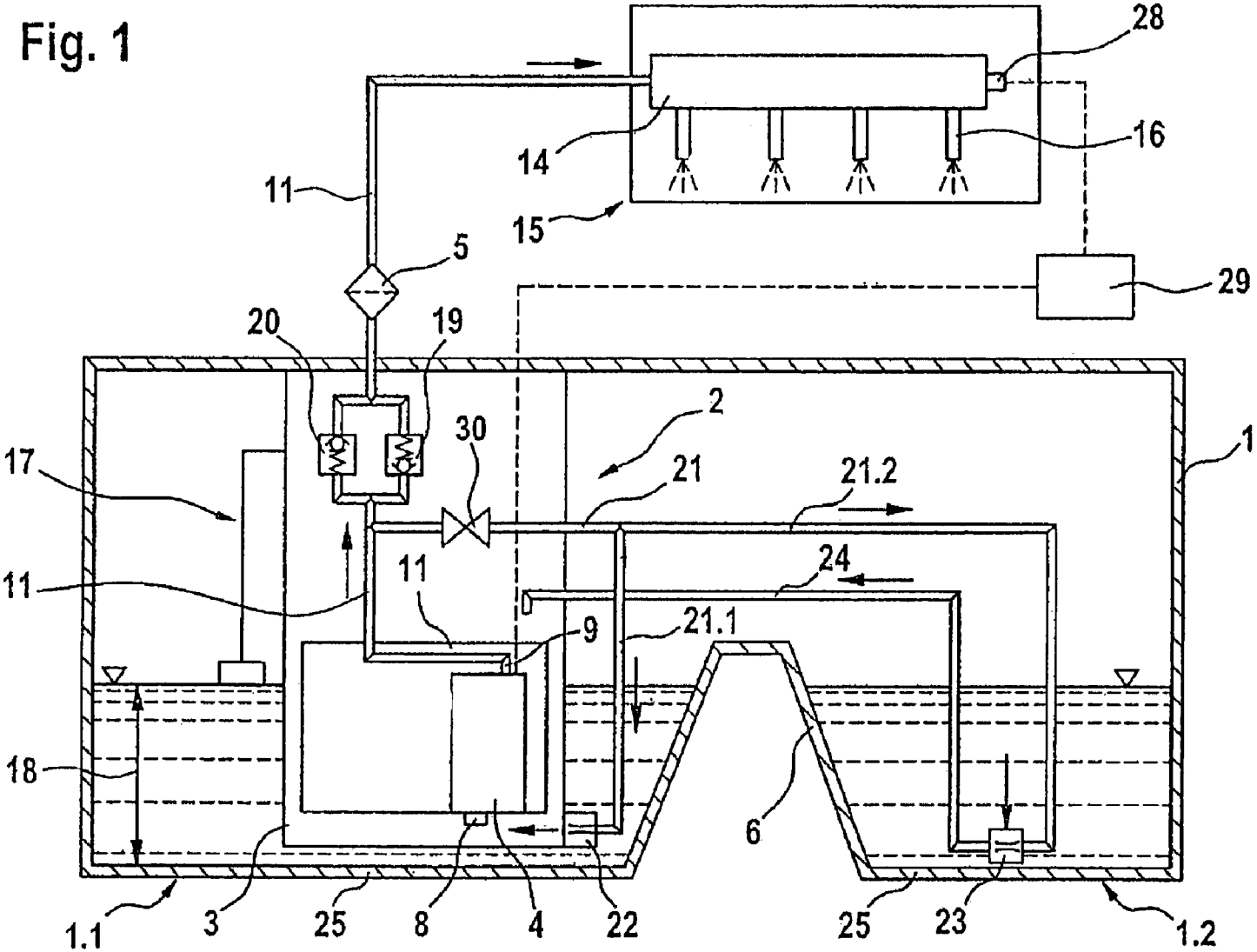
FIG. 1 shows a view of a device for pumping fuel.

FIG. 1 shows a device for pumping fuel from a tank to an internal combustion engine, in which a shutoff valve of the invention could be used. The device serves to make enough fuel for combustion in a combustion chamber available to an internal combustion engine.

The device has a feed module 2, located in a tank 1, the feed module having a cylindrical splash pot 3, in which a feed pump 4 and a main filter 5, for instance, are located. The feed pump 4 is for instance an electric fuel pump. The feed pump 4 aspirates fuel from the splash pot 3, for instance via an input conduit 8, and pumps the fuel under pressure via an output conduit 9 of the feed pump 4 into a pressure line 11, which leads for instance to a fuel distributor 14 of an internal combustion engine 15. The fuel distributor 14 is in communication with a plurality of injection valves 16, which inject the fuel into cylinders, not shown, of the engine. The pressure line 11 may also, however, communicate downstream with a high-pressure pump of a so-called direct gasoline injection or a diesel injection system, which injects the fuel at high pressure into a fuel distributor and via injection valves into cylinders of the engine.

The fuel tank 1 is for instance a so-called saddle tank with a saddle 6, which divides the tank 1 into at least two separate regions, such as a first region 1.1 and a second region 1.2. The feed module 2 is located in the first region 1.1, for instance.

A know tank gauge 17 is provided on the splash pot 3, for measuring a fuel level 18 in the tank 1.

The main filter 5 is provided in the pressure line 11. The pressure line 11, upstream or downstream but for example upstream of the main filter 5, has a check valve 19, which opens in the direction of the engine 15 and prevents a reverse flow of fuel from downstream of the check valve 19 to upstream of the check valve 19. In this way, the check valve 19 maintains the pressure in the pressure line 11 downstream of the check valve 19 even after the feed pump 4 has been shut off. In the pressure line 11, parallel to the check valve 19, a pressure relief valve 20 may be provided, which opens at a pressure in the pressure line 11 downstream of the check valve 19 that is greater than or equal to a predetermined opening pressure and allows fuel to flow back out of the pressure line 11 from downstream of the check valve 19 to upstream of the check valve 19 for the sake of pressure relief. The pressure relief valve 20 opens in the opposite direction from the check valve 19. The connection, toward the pressure line 11 downstream of the check valve 19, of the pressure limiting valve 20 communicates fluidically for instance with the pressure line 11 upstream of the main filter 5, as shown in FIG. 1, or with the pressure line 11 downstream of the main filter 5, as shown for instance in FIG. 2.

If the pressure in the pressure line 11 downstream of the check valve 19 reaches or drops below the predetermined opening pressure, the pressure relief valve 20 closes again. A pressure increase in the pressure line 11 with a resultant opening of the pressure relief valve 20 can be caused for instance by a rise in the temperature after the shutoff of the engine 15.

A drive line 21, which supplies one or more suction jet pumps with fuel, branches off from the pressure line 11 upstream of the check valve 19. In the case of a saddle tank, the drive line 21 for instance branches into a first drive line portion 21.1 and a second drive line portion 21.2; the first drive line portion 21.1 is in fluidic communication with a first suction jet pump 22, and the second drive line portion 21.2 is in fluidic communication with a second suction jet pump 23. The first suction jet pump 22 is located for instance adjacent to the feed module 2, and in operation, it pumps fuel out of the first region 1.1 of the fuel tank 1 into the splash pot 3 of the feed module 2. The second suction jet pump 23 is provided for instance in the second region 1.2 of the fuel tank 1, and in operation, it pumps fuel out of the second region 1.2 via a return line 24 also into the splash pot 3 or into the first region 1.1 of the fuel tank 1. The first suction jet pump 22 and the second suction jet pump 23 are each located near a tank bottom 25 of the fuel tank 1.

The rpm of the feed pump 4 is regulated as a function of the pressure downstream of the feed pump 4, for instance as a function of the pressure in the pressure line 11 or as a function of the pressure in the fuel distributor 14. To that end, a pressure sensor 28 is provided, which ascertains the pressure, for instance in the pressure line 11 or in the fuel distributor 14, and carries it as a controlled variable to an electronic control unit 29, which takes on the task of regulating the feed pump 4. The fuel pumping with rpm regulation of the feed pump 4 is also known as need-based fuel pumping.

A shutoff valve 30 is located in the drive line 21, for instance upstream of the drive line portions 21.1, 21.2. The shutoff valve 30 serves to shut off the fuel supply to the suction jet pumps 22, 23, which is effected via the drive line 21, at fuel pressures in the pressure line 11 greater than or equal to a predetermined value. This is necessary so that as soon as possible during or after engine starting, a predetermined pressure can be built up in the pressure line 11 and the fuel distributor 14. If upon engine starting the suction jet pumps 22, 23 were to be uninterruptedly in operation, then a more-powerful feed pump 4 would be necessary, in order to rapidly reach the predetermined pressure in the pressure line 11. Putting the suction jet pumps 22, 23 out of operation during engine starting allows the predetermined pressure in the pressure line 11 to be achieved fast enough, without a more-powerful and more-expensive feed pump 4.

According to the invention, the pressure downstream of the feed pump 4, for instance the pressure of the pressure line 11 or of the drive line 21, acts on the shutoff valve 30 in such a way that this valve closes automatically at a pressure greater than or equal to a predetermined closing pressure. As a result, a flow cross section of the drive line 21 is closed, so that no further fuel from the pressure line 11 reaches the suction jet pumps 22, 23.

Upon engine starting, the feed pump 4 is regulated such that the pressure in the pressure line 11 attains a value which is greater than the closing pressure of the shutoff valve 30, and greater than the pressure in the pressure line 11 at full load.

The shutoff valve 30 of the invention can be produced markedly more economically than a shutoff valve 30 that is for instance actuated electromagnetically.

Figure 2:
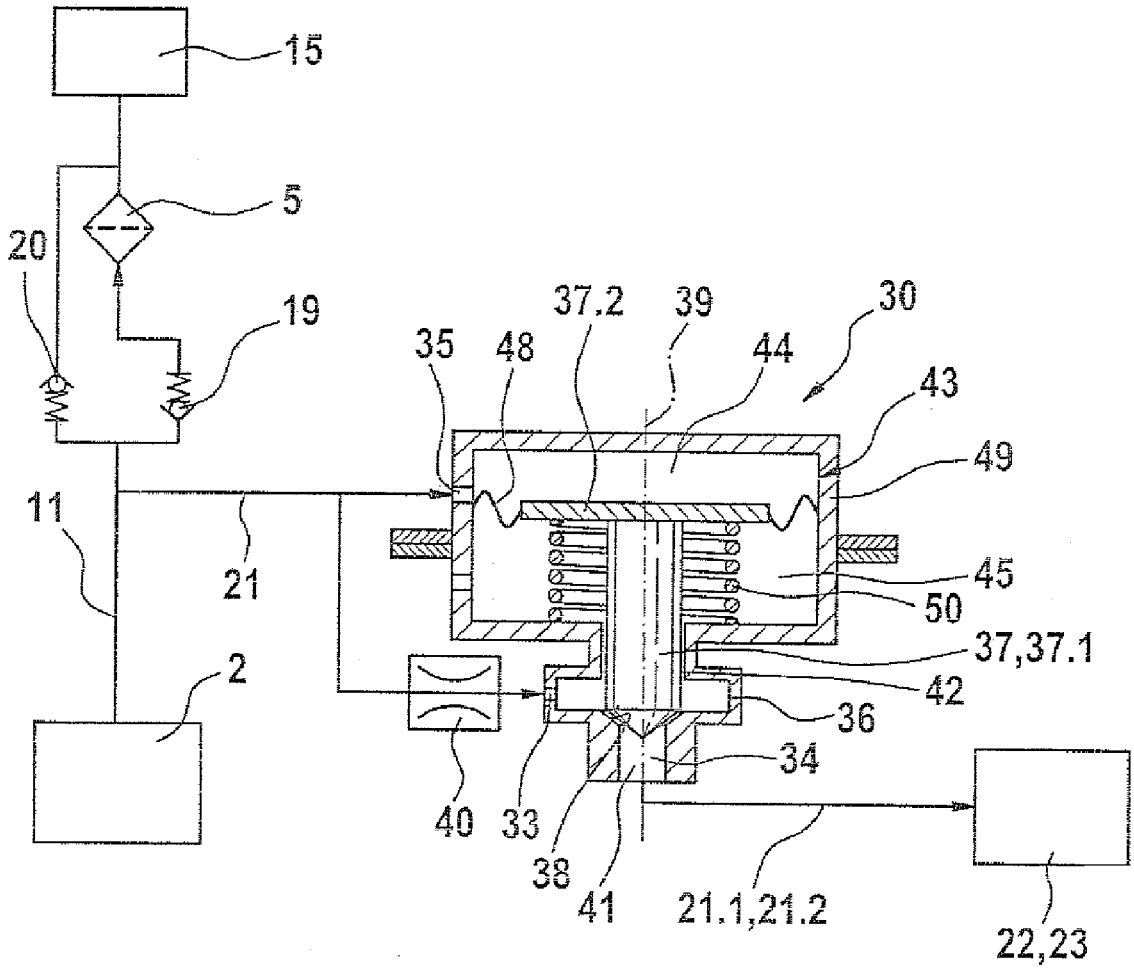
FIG. 2 shows a first exemplary embodiment of a shutoff valve of the invention.

FIG. 2, in section, shows a view of a first exemplary embodiment of the shutoff valve of the invention.

In the device of FIG. 2, the elements that remain or function the same as in the device of FIG. 1 are identified by the same reference numerals.

In the first exemplary embodiment, the shutoff valve 30 of the invention is embodied as a diaphragm valve.

The shutoff valve 30 for instance has an input connection 33, an output connection 34, and a control connection 35. The input connection 33 communicates with the portion of the drive line 21 leading to the pressure line 11, and the output connection 34 communicates with the portion of the drive line 21 leading to the at least one suction jet pump 22, 23. The control connection 35 communicates fluidically with the pressure line 11, for instance indirectly via the drive line 21.

In the drive line 21, a throttle element 40, for instance, is located upstream or downstream of the shutoff valve 30, in order to limit the volumetric flow to the at least one suction jet pump 22, 23. The throttle element 40 may also be located in the drive line 21, 21.1, 21.2 downstream of the output connection 34 of the shutoff valve 30.

The input connection 33 discharges into a valve chamber 36 of the shutoff valve 30, the valve chamber for instance being cylindrical. In the valve chamber 36, a first closing body 37, movable axially with respect to a valve axis 39, and a first valve seat 38, cooperating with the first closing body 37, are provided. The first closing body 37 and the first valve seat 38 for instance form a ball-cone, cone-ball, cone-cone or ball-ball seat, or a flat seat. The output connection 34 of the shutoff valve 30 discharges into the valve chamber 36, via a valve seat opening 41 that is closable by the first closing body 37. The first closing body 37 is for instance embodied in pistonlike form, with a first piston portion 37.1 and/or a second piston portion 37.2; the first piston portion 37.1 cooperates with the first valve seat 38 and extends from the valve chamber 36 via a valve conduit 42 as far as the inside of a for instance cylindrical control chamber 43 of the shutoff valve 30. The first closing body 37 is guided axially in the valve conduit 42 by the first piston portion 37.1. The second piston portion 37.2 is located in the control chamber 43 and is connected integrally with the first piston portion 37.1. The second piston portion 37.2 divides the control chamber 43 for instance into a pressure chamber 44, communicating fluidically with the control connection 35, and a spring chamber 45, communicating fluidically with the atmosphere. The pressure chamber 44 is sealed off from the spring chamber 45, for instance by means of a diaphragm 48, which extends, beginning at the second piston portion 37.2, radially outward as far as a housing wall 49 of the control chamber 43. The valve chamber 36 is also sealed off for instance from the spring chamber 45 of the control chamber 43. A restoring spring 50 is located in the spring chamber 45; on one end, it is braced on the housing wall 49 of the control chamber 43, and by its other end it acts on the second piston portion 37.2. The restoring spring 50 presses the closing body 37 in the direction remote from the first valve seat 38. The pressure of the pressure line 11 conversely acts via the control connection 35 on the second piston portion 37.2 of the first closing body 37 and presses this closing body in the direction of the first valve seat 38, counter to the direction of action of the restoring spring 50.

When the feed pump 4 is off, the pressure line 11 upstream of the check valve 19, and therefore also the drive line 21 and the pressure chamber 44 of the control chamber 43 are all pressureless with regard to the atmosphere. Because of the balance of forces at the first closing body 37, comprising the pressure force acting in the pressure chamber 44 and the spring force of the restoring spring 50, a resultant force on the first closing body 37 in the opening direction therefore results, so that when the feed pump 4 is off, the shutoff valve 30 is open.

As soon as the feed pump 4 is switched on, it builds up a pressure in the pressure line 11, which propagates via the drive line 21 and the control connection 35 as far as the inside of the pressure chamber 44, minus a pressure loss. The restoring spring 50 is designed such that the first closing body 37 presses against the first valve seat 38 at a pressure in the pressure chamber 44 that is greater than or equal to a predetermined closing pressure and in this way closes the shutoff valve 30. The predetermined closing pressure of the shutoff valve 30 is greater than the pressure in the pressure line 11 at full load operation of the engine 15, or is equal to that pressure. The predetermined closing pressure of the shutoff valve 30 is preferably in the range of between 6 and 9 bar. In this way, it is assured that the at least one suction jet pump 22, 23 will be on even at full load, and the splash pot 3 will always be adequately well filled.

The shutoff valve 30 is thus first opened upon engine starting and closes as soon as the pressure in the pressure line 11 reaches or exceeds the predetermined closing pressure, and then opens again as the soon the pressure in the pressure line 11 drops below the predetermined closing pressure.

Figure 3:
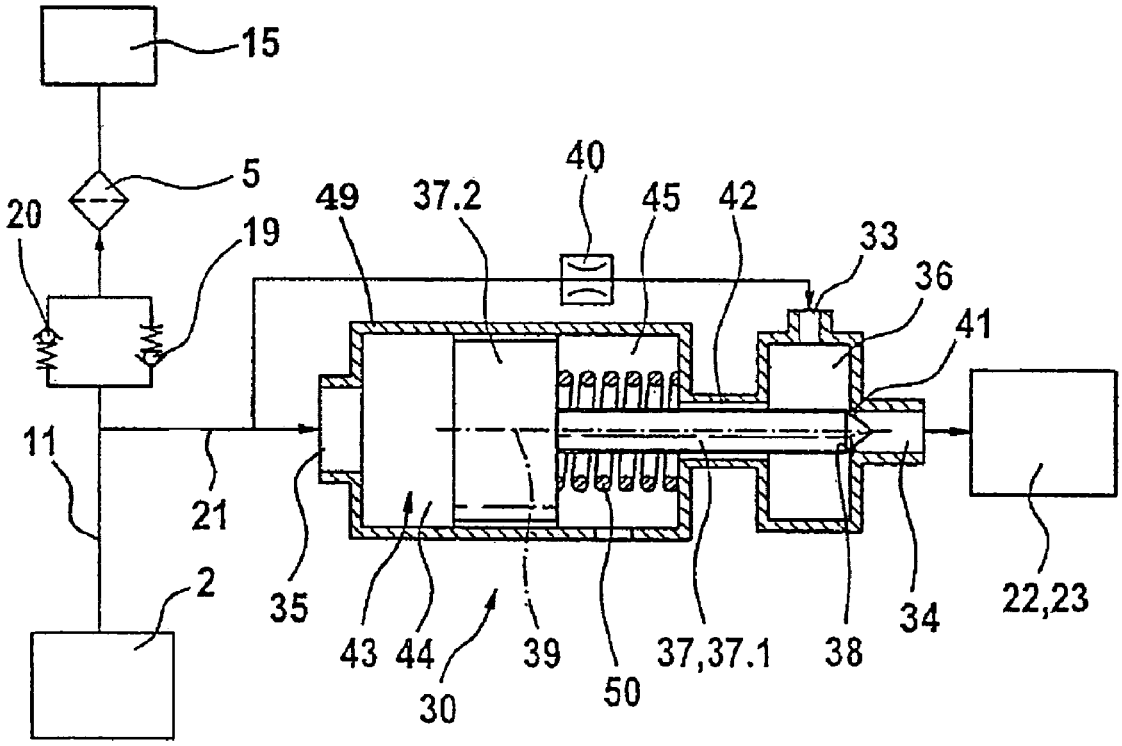
FIG. 3 shows a second exemplary embodiment.

FIG. 3 shows a view in section of a second exemplary embodiment of the shutoff valve of the invention.

In the device of FIG. 3, the elements that remain or function the same as in the device of FIGS. 1 and 2 are identified by the same reference numerals.

The shutoff valve of FIG. 3 differs from the shutoff valve of FIG. 2 in that the shutoff valve 30 is embodied not as a diaphragm valve but as a piston valve. The second piston portion 37.2, in its radial extent relative to the valve axis 39, extends as far as the housing wall 49 of the control chamber 43, and in this way it divides the control chamber 43 into the pressure chamber 44 and the spring chamber 45. The diaphragm 48 in FIG. 2 is therefore omitted. The second piston portion 37.2 for instance has a greater axial length than in the first exemplary embodiment, in order to attain good sealing between the pressure chamber 44 and the spring chamber 45 and to avoid canting of the second piston portion 37.2 with respect to the housing wall 49 of the control chamber 43.

Figure 4:
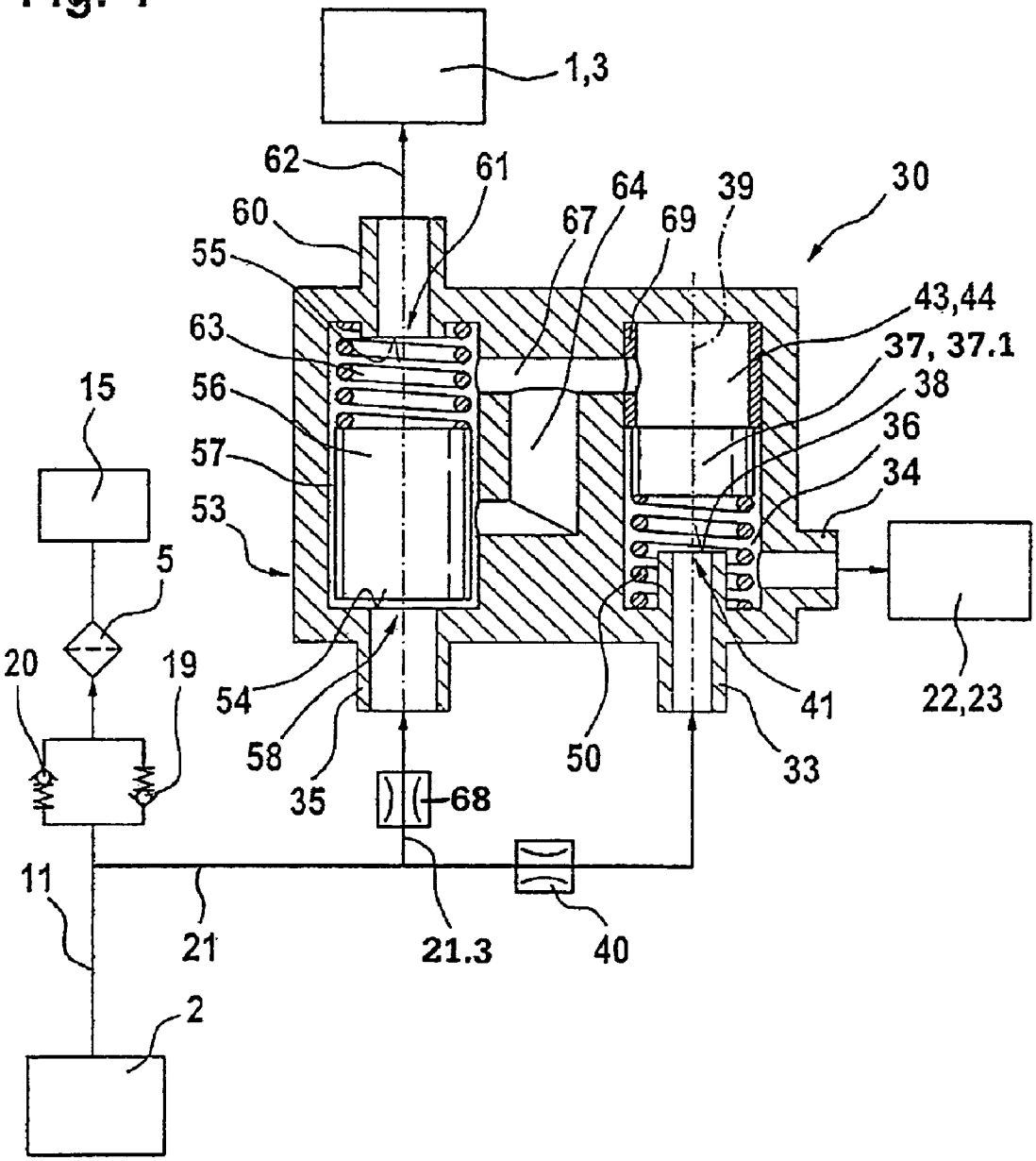
FIG. 4 shows a third exemplary embodiment of the shutoff valve of the invention.

FIG. 4 shows a view in section of a third exemplary embodiment of the shutoff valve of the invention.

In the device of FIG. 4, the elements that remain or function the same as in the device of FIGS. 1 through 3 are identified by the same reference numerals.

The shutoff valve of FIG. 4 differs from the shutoff valve of FIG. 3 essentially in that the first closing body 37 has only a first piston portion 37.1, and the control chamber 43 is preceded in the flow direction by a control valve 53. The control valve 53 is connected for instance integrally with the shutoff valve 30, but may also be provided separately. The control valve 53 is located for instance in the shutoff valve 30 downstream of the control connection 35 and upstream of the control chamber 43. The control valve 53 has for instance a second closing body 56, which cooperates with a second valve seat 54 and a third valve seat 55 and is for instance embodied in pistonlike form and is axially movable in a cylinder chamber 57 between the second valve seat 54 and the third valve seat 55. The control connection 35 discharges into the cylinder chamber 57 via an inlet opening 58; the second valve seat 54 is located at the inlet opening 58 and annularly surrounds it. The second valve seat 54 and the third valve seat 55 are embodied for instance as flat seats, but may also be embodied as ball or cone seats. The control valve 53 has a leak fuel connection 60, which discharges via a leak fuel opening 61 into the cylinder chamber 57; the third valve seat 55 is located at the leak fuel opening 61 and annularly surrounds it. The leak fuel connection 60 communicates fluidically with the tank 1 or the splash pot 3, for instance via a leak fuel line 62. The second closing body 56 is pressed in the direction of the second valve seat 54 by a closing spring 63 located in the cylinder chamber 57. The closing spring 63 is designed such that the control valve 53 opens at a pressure in the pressure line 11 that is equal to or greater than a predetermined opening pressure. The predetermined opening pressure of the control valve 53 is greater than the pressure in the pressure line 11 at full load operation of the engine and amounts for instance to between 6 and 9 bar. In this exemplary embodiment, the restoring spring 50 acting on the first closing body 37 is designed such that the shutoff valve 30 closes as soon as the control valve 53 opens and the control chamber 43 is subjected to pressure by the fuel in the pressure line 11.

The cylinder chamber 57 communicates with the control chamber 43 of the shutoff valve 30 both via a control conduit 64 and a leak fuel conduit 67. The control conduit 64 discharges at one end for instance into a portion of the cylinder chamber 57 oriented toward the second valve seat 54 having the control connection 35, and the leak fuel conduit 67 with one end discharges for instance into a portion of the cylinder chamber 57 oriented toward the third valve seat 55 with the leak fuel connection 60. The control conduit 64 and the leak fuel conduit 67 discharge on their other end, for instance with a common conduit portion, into the control chamber 43. Once the second closing body 56 is in contact with the third valve seat 55, the control connection 35 is in communication with the control chamber 43 via the cylinder chamber 57 and the control conduit 64, and the second closing body 56 tightly closes not only the end of the leak fuel conduit 67, oriented toward the cylinder chamber 57, but also the leak fuel opening 61. As a result, the control chamber 43 is subjected to the pressure of the pressure line 11. Upon contact of the second closing body 56 with the second valve seat 54, the control chamber 43 communicates fluidically with the leak fuel connection 60, and the second closing body 56 closes the end, toward the cylinder chamber 57, of the control conduit 64 and the inlet opening 58. In this way, the control chamber 43 is pressure-relieved to the atmosphere, since the fuel tank 1 is at atmospheric pressure.

As soon as the second closing body 56 of the control valve 53, as a result of the pressure of the pressure line 11 acting on the face end of the second closing body 56 via the control connection 35, lifts from the second valve seat 54, opens the inlet opening 58, and closes the leak fuel conduit 67 toward the cylinder chamber 57, the control connection 35 is in fluidic communication with the control chamber 43, via the inlet opening 58, the cylinder chamber 57, and the control conduit 64, and in this way subjects the control chamber 43 to the pressure of the pressure line 11. When the inlet opening 58 of the control valve 53 is open, the first closing body 37 is moved against the first valve seat 38, counter to the spring force of the restoring spring 50, and the shutoff valve 30 is closed by the closure of the valve seat opening 41, so that no fluffier fuel reaches the valve chamber 36, via the input connection 33 and the valve seat opening 41, and the at least one suction jet pump 22, 23, via the valve chamber 36 and the output connection 34.

As soon as the pressure of the pressure line 11 drops below the predetermined opening pressure of the control valve 53, the second closing body 56 moves back again against the second valve seat 54, so that first, the leak fuel opening 61 and the leak fuel conduit 67 are opened toward the cylinder chamber 57, and next, the control conduit 64 is closed toward the cylinder chamber 57 and the inlet opening 58 is closed. Since the control chamber 43 is pressure-relieved in this way, the first closing body 37 is moved by the restoring spring 50 in the direction remote from the first valve seat 38. As it does so, the first closing body 37 positively displaces fuel out of the control chamber 43 into the leak fuel line 62, via the leak fuel line 67, the cylinder chamber 57, and the leak fuel connection 60.

A further throttle element 68 may be located in a drive line portion 37.3, leading to the control connection 35, of the drive line 37.

The valve chamber 36 and the control chamber 43, in the third exemplary embodiment, are separated from one another only by the first closing body 37. For limiting the stroke of the first closing body 37, a hollow-cylindrical stop 69 is for instance provided in the control chamber 43.

The foregoing relates to a preferred exemplary embodiment of the invention, it being understood that other variants and embodiments thereof are possible within the spirit and scope of the invention, the latter being defined by the appended claims.

The invention claimed is:

1. In a device for pumping fuel, having a suction jet pump and a drive line that supplies the suction jet pump with fuel, which drive line branches off from a pressure line leading to an internal combustion engine and is closable by means of a shutoff valve, the improvement wherein the pressure of the pressure line acts on the shutoff valve in such a way that the shutoff valve closes at a pressure that is greater than or equal to a predetermined closing pressure, and wherein the closing pressure of the shutoff valve is greater than the pressure in the pressure line in full-load operation of the engine, wherein the feed pump is regulated upon engine starting such that the pressure in the pressure line attains a value which is greater than the closing pressure of the shutoff valve and greater than the pressure in the pressure line at full load, wherein the shutoff valve has both an input connection, fluidically communicating upstream with the pressure line, and a control connection as well as an output connection leading downstream to the at least one suction jet pump, and wherein the input connection discharges into a valve chamber, in which a first closing body, cooperating with a first valve seat is located.

2. The device as defined by claim 1, wherein the shutoff valve is embodied as a diaphragm valve or as a piston valve.

3. The device as defined by claim 1, wherein the first closing body is embodied in piston-like fashion, with a first piston portion and/or a second piston portion.

4. The device as defined by claim 1, further comprising a restoring spring, the restoring spring acting on the first closing body in the direction remote from the first valve seat.

5. The device as defined by claim 1, wherein the control connection discharges into a control chamber, in which the pressure of the pressure line acts on the first closing body in the direction toward the first valve seat.

6. The device as defined by claim 5, wherein the first piston portion is located in the valve chamber and reaches as far as the inside of the control chamber, and the second piston portion is provided in the control chamber.

7. The device as defined by claim 1, further comprising a check valve located in the pressure line, the drive line branching off from the pressure line upstream of the check valve.

8. The device as defined by claim 1, wherein the drive line comprises a throttle element.

9. The device as defined by claim 5, further comprising a control valve between the control connection and the control chamber.

10. The device as defined by claim 9, wherein the control valve is connected integrally with the shutoff valve.

11. The device as defined by claim 9, wherein the control valve comprises a second closing body cooperating with a second valve seat and a third valve seat.

12. The device as defined by claim 11, wherein the second closing body is embodied in piston-like fashion and is axially movable between the second valve seat and the third valve seat.

13. The device as defined by claim 11, wherein the control valve comprises a closing spring which acts on the second closing body in the direction toward the second valve seat.

14. The device as defined by claim 11, wherein the control chamber communicates fluidically with a leak fuel connection when the second closing body is in contact with the second valve seat.

15. The device as defined by claim 11, wherein the control chamber communicates fluidically with he control connection when the second closing body is in contact with the third valve seat.

* * * * *